US009940855B2

(12) United States Patent
Kaoh

(10) Patent No.: US 9,940,855 B2
(45) Date of Patent: Apr. 10, 2018

(54) LOTTERY SIGNS FOR DISPLAYING LOTTERY JACKPOTS OF MILLIONS TO BILLIONS OF DOLLARS

(71) Applicant: Andy K. F. Kaoh, Costa Mesa, CA (US)

(72) Inventor: Andy K. F. Kaoh, Costa Mesa, CA (US)

( * ) Notice: Subject to any disclaimer, the term of this patent is extended or adjusted under 35 U.S.C. 154(b) by 0 days.

(21) Appl. No.: 14/861,069

(22) Filed: Sep. 22, 2015

(65) Prior Publication Data

US 2017/0084209 A1 Mar. 23, 2017

(51) Int. Cl.
*G09F 9/302* (2006.01)
*G09F 9/33* (2006.01)
*G09G 3/14* (2006.01)

(52) U.S. Cl.
CPC ..... *G09F 9/3023* (2013.01); *G09F 9/33* (2013.01); *G09G 3/14* (2013.01)

(58) Field of Classification Search
CPC ..... G09F 9/3023; G09F 9/33; G09G 3/14
See application file for complete search history.

(56) References Cited

U.S. PATENT DOCUMENTS 3,782,016 A * 1/1974 Ashton ..... G09F 9/305 40/451
5,753,900 A * 5/1998 Goodwin, III ..... G09F 9/33 235/383
6,317,184 B1 * 11/2001 Kwan ..... G09F 9/302 349/139
7,880,755 B1 * 2/2011 Potash ..... B41J 2/3355 347/200
2003/0072168 A1 * 4/2003 Hou ..... G09F 9/30 362/545
2003/0156038 A1 * 8/2003 Hankins ..... G09F 9/33 340/815.45
2004/0233220 A1 * 11/2004 Decaux ..... G09F 9/00 345/619
2004/0246203 A1 * 12/2004 Nakaoka ..... G09F 9/305 345/39
2005/0102870 A1 * 5/2005 Catteau ..... G09F 9/302 40/450
2005/0134529 A1 * 6/2005 Lei ..... G09G 3/14 345/34
2006/0001598 A1 * 1/2006 Lei ..... G09F 9/302 345/34

(Continued)

*Primary Examiner* — Gary C Hoge
(74) *Attorney, Agent, or Firm* — Myers Andras LLP; Joseph C. Andras

(57) ABSTRACT

An illuminated display for displaying a lottery jackpot values in the range of millions and billions of dollars is disclosed. A lottery display comprises a string of three LED modules positioned next to each other, where the leftmost LED module indicates the hundreds place for a jackpot value, the center LED module indicates the tens place, and the rightmost LED module indicates the ones place for the jackpot. Conventional LED modules having seven segments may be employed for the indicia of the hundreds and tens values. A special LED module having nine segments may be employed for the indicia of units, where the LED module may be illuminated to form the numerals 0 through 9, as well as an upper case letter "B." The illuminated display may also display indicia for currency and the day of the week for the jackpot draw.

23 Claims, 9 Drawing Sheets

(56) References Cited

U.S. PATENT DOCUMENTS

| | | | | |
|---|---|---|---|---|
| 2008/0028649 | A1* | 2/2008 | Van Ness | G09F 9/30 40/447 |
| 2013/0255116 | A1* | 10/2013 | Kaoh | G09F 27/005 40/563 |
| 2014/0335976 | A1* | 11/2014 | Hiller | A63B 69/0071 473/447 |
| 2016/0042673 | A1* | 2/2016 | Wilson | G09F 9/33 40/541 |

* cited by examiner

LOTTERY SIGNS FOR DISPLAYING LOTTERY JACKPOTS OF MILLIONS TO BILLIONS OF DOLLARS

BACKGROUND OF THE INVENTION

1. Field of the Invention

The present invention relates in general to lottery display signs. More particularly, the invention is directed to lottery display signs which can display millions and billions of dollars for the lottery jackpot.

2. Description of the Related Art

Many governments rely on lotteries to raise government revenues. Electronic lottery signs are often used to highlight establishments which offer lottery tickets for sale as well as to inform the public of the current jackpot value, which may motivate some consumers to purchase lottery tickets when the jackpot is large. Lottery jackpots may exceed hundreds of millions of dollars, but may soon reach one billion dollars or more.

Most conventional lottery signs, however, are not configured to display lottery jackpots which exceed one billion dollars.

Accordingly, a need exists to provide lottery signs which can display lottery jackpots in both millions and in excess of one billion dollars.

SUMMARY OF THE INVENTION

In the first aspect, an illuminated display for displaying a lottery jackpot value in the range of millions and billions of currency is disclosed. The display comprises a flat housing unit having a front surface, one or more seven segment light emitting diode ("LED) modules mounted in the housing and configured to provide a visible indicia of numerals, and a nine segment LED module configured to display indicia of numerals and indicia of an uppercase letter "B". The display further comprises a controller for operating the one or more seven segment LED modules and the nine segment LED module, the controller receiving a lottery jackpot value and displaying the lottery jackpot value on the seven and nine segment LED modules, wherein the controller energizes the nine segment LED module to display an uppercase letter "B" when the lottery jackpot value is equal to or exceeds one billion of currency. The display further comprises a transparent backlight panel extending across the front surface of the housing unit, and a replaceable graphic overlay placed on the front surface of the housing unit, the replaceable graphic overlay configured to be backlit by the backlight panel, the graphic overlay having visible indicia.

In a first preferred embodiment, the nine segment LED module comprises seven LED segments having four vertical segments and three horizontal segments including a top, middle, and bottom horizontal segment, the seven LED segments forming a figure "8", the nine segment LED module further comprising a first interior vertical segment extending from the bottom horizontal segment to the middle horizontal segment, and a second vertical segment extending from the middle horizontal segment to the top horizontal segment, the first and second interior vertical segments positioned collinear with each other and parallel with the four vertical segments of the seven LED segments.

The nine segment LED module preferably comprises three substantially horizontal discrete and elongated LED line segments including an upper, middle, and lower horizontal line segments, two aligned, substantially vertical line segments positioned on the left of the upper, middle, and lower horizontal line segments comprising a top left vertical line segment and a bottom left vertical line segment, the top left vertical segment extending from the left end of the middle horizontal line segment to the left end of the upper horizontal line segment, the bottom left horizontal line segment extending from the left end of the middle horizontal line segment to the left end of the lower horizontal line segment. The nine segment LED module preferably further comprise two aligned, substantially vertical line segments positioned on the right of the upper, middle, and lower horizontal line segments comprising a top right vertical line segment and a bottom right vertical line segment, the top right vertical segment extending from the right end of the middle horizontal line segment to the right end of the upper horizontal line segment, the bottom right vertical line segment extending from the right end of the middle horizontal line segment to the right end of the lower horizontal line segment, and two aligned, substantially vertical interior line segments positioned to the left of the centers of the upper, middle, and lower horizontal line segments comprising a top interior vertical line segment and a bottom interior vertical line segment, the top interior vertical line segment extending from left of the center of the middle horizontal line segment to the left of the center of the upper horizontal line segment, the bottom interior vertical line segment extending from the left of the center the middle horizontal line segment to the left of the center of the lower horizontal line segment.

The illuminated display preferably further comprises three alphanumeric LED modules configured to display indicia of a day of a week. Each of the alphanumeric LED modules preferable comprises a 13 segment LED module. One or more of the seven segment LED modules or the nine segment LED module preferably further comprises an LED decimal point. The graphic overlay preferably further comprises a window section for passing the light from the seven and nine segment LED module, indicia of currency, and indicia of "MILLION." The indicia of currency are preferably indicia of dollars. The controller preferably repeatedly and periodically energizes and de-energizes the nine segment LED module to display a blinking, uppercase letter "B" when the lottery jackpot value is equal to or exceeds one billion of currency.

In a second aspect, an illuminated display for displaying a lottery jackpot value in the range of millions and billions of currency is disclosed. The display comprises a flat housing unit having a front surface, and a light emitting array of light emitting diodes ("LEDs) mounted in the housing, the light emitting array of LEDs configured to provide visual indicia of numerals and a visual indicia of an uppercase letter "B" to a user.

In a second preferred embodiment, the illuminated display further comprises a controller for operating the light emitting array, the controller receiving a lottery jackpot value and displaying the lottery jackpot value on the light emitting array, where the controller determines when the lottery jackpot value is equal to or exceeds one billion of currency and energizes the light emitting array to display the indicia of the uppercase letter "B" to the user. The display preferably further comprises three alphanumeric LED modules configured to display indicia of a day of a week.

Each of the alphanumeric LED modules preferably comprises a 13 segment LED module. The light emitting array of LEDs preferably further comprises an LED decimal point. The graphic overlay preferably further comprises a window section for passing the light from the seven and nine segment LED module, indicia of currency, and indicia of "MILLION." The indicia of currency are preferably indicia of dollars.

The controller preferably repeatedly and periodically energizes and de-energizes the light emitting array of LEDs configured to provide visual indicia of numerals and a visual indicia of a blinking, uppercase letter "B" to the user.

In a third aspect, a method for controlling an illuminated display for displaying a lottery jackpot value in the range of millions and billions of currency is disclosed. The method comprises receiving a lottery jackpot value by a controller, determining if the lottery jackpot value is equal to or exceeds one billion of currency, and energizing a light emitting array of light emitting diodes ("LEDs") to form visual indicia of the lottery jackpot value and of an uppercase letter "B."

In a third preferred embodiment, the method further comprises receiving the day of lottery draw by the controller, and energizing the light emitting array of LEDs to form a visual indicia of the day of the lottery draw. The controller preferably continuously receives updated lottery jackpot values and automatically updates the light emitting array of LEDs.

These and other features and advantages of the invention will become more apparent with a description of preferred embodiments in reference to the associated drawings.

DETAILED DESCRIPTION OF THE PREFERRED EMBODIMENTS

Figure 1:
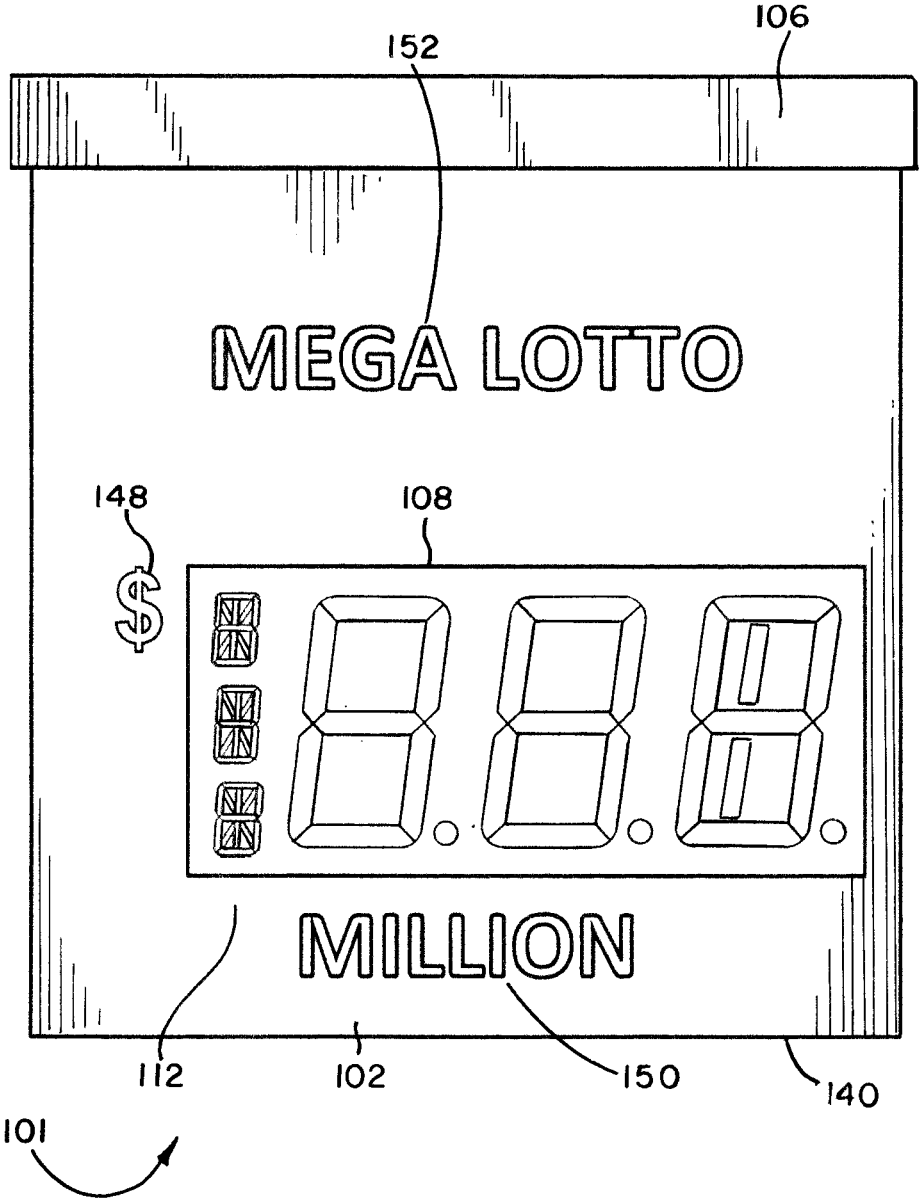
FIG. 1 is a front view of a lottery sign in one or more embodiments.

Government operated lotteries exist in over 40 U.S. states, as well as in over 100 countries in the world. The proceeds from the lotteries are used to supplement governmental revenues, and may be used for various causes such as for education, economic development programs, facility improvements, and tax relief, for example. Consumers may purchase lottery tickets from many convenience stores, gas stations, and supermarkets.

Many of the venues for purchasing lottery tickets may use electronic signs which indicate the current lottery jackpot, as well as the day of the week for the next draw. Many consumers may be persuaded to purchase lottery tickets when the lottery jackpot is large or near record amounts. Currently, lottery jackpots may exceed hundreds of millions of dollars, but are expected to surpass one billion dollars at some point. Many conventional lottery signs are unable to indicate jackpots of one billion dollars or more unambiguously. For example, one approach for indicating a billion dollar jackpot may form a lowercase letter "b" on a conventional seven segment LED. However, this approach is unacceptable as many consumers may misinterpret the symbol as a "6" instead of a "b."

An illuminated display for displaying a lottery jackpot value in the range of millions and billions of dollars is contemplated in one or more embodiments. In an embodiment, a lottery display comprises a string of three LED modules positioned next to each other, where the leftmost LED module indicates the hundreds place for a jackpot value, the center LED module indicates the tens place, and the rightmost LED module indicates the ones place for the jackpot. Conventional LED modules having seven segments may be employed for the indicia of the hundreds and tens values. A special LED module having nine segments may be employed for the indicia of units, where the LED module may be illuminated to form the numerals 0 through 9, as well as an upper case letter "B." The LED module with nine segments is based on the conventional seven segment LED module but uniquely includes two additional vertical segments, which, when lit, with certain other segments will form an unambiguous uppercase letter "B." In one or more embodiments, the uppercase letter "B" may blink to indicate that the jackpot exceeds 1 billion dollars.

Teachings relating to the illuminated display signs disclosed in U.S. patent application Ser. No. 13/436,719 filed Mar. 30, 2012 entitled "ADJUSTABLE ILLUMINATED LOTTERY SIGN" which issued as U.S. Pat. No. 8,826,572 on Sep. 9, 2014 may be employed herein and the disclosure of which is incorporated herein by reference in its entirety. Embodiments described herein describe lotteries with jackpots listed in dollars. However, it shall be understood that lottery displays depicting other currencies are contemplated in one or more embodiments. Embodiments described herein make reference to LED modules having several line segments as well as to multiple discrete LEDs positioned to form the shape of numerals and letters. It shall be understood that the teachings of LED segmented displays and discrete LEDs are interchangeable, and may be applied to other forms of segmented displays or groups of discrete LED devices.

FIG. 1 is a front view of an illuminated lottery display 101 in one or more embodiments. The illuminated display 101 has a flat housing 102 held in place by a frame 106. The housing 102 has a set of light emitting arrays 108. The light emitting array 108 is depicted as segmented LED modules. However, it shall be understood that either segmented or discrete LEDs may be employed in one or more embodiments.

Figure 2:
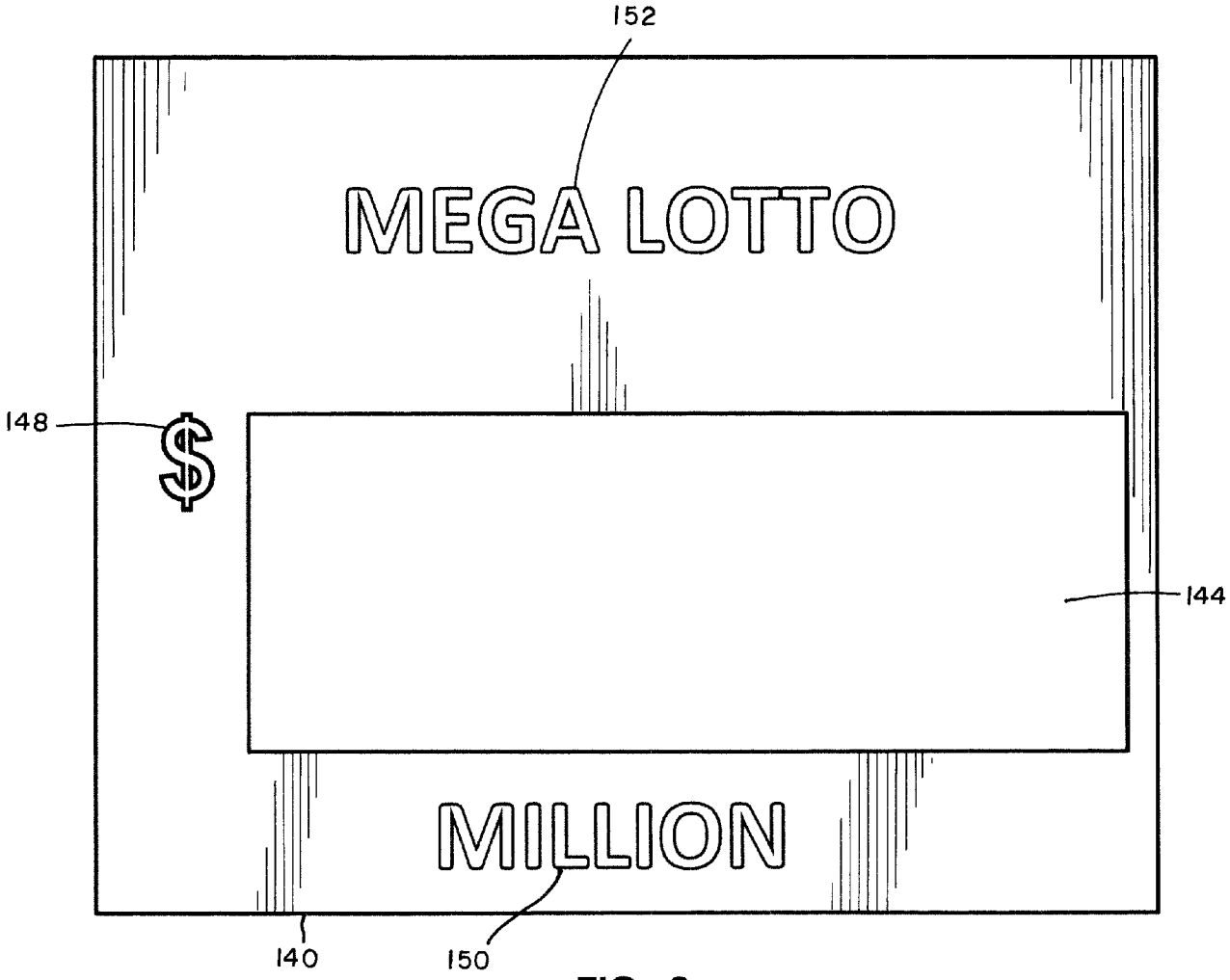
FIG. 2 is a front view of the graphic overlay.

As illustrated in FIG. 2, a graphic overlay 140 is placed over the housing 102. As illustrated in FIG. 2, the graphic overlay 140 has a logo 152, illustrated here as "MEGA LOTTO," as well as visual indicia of currency 148, illustrated here as a dollar sign ("$"), and visual indicia for "MILLION" 150. The graphic overlay 140 has a window 144 for passing the light from the light emitting array 108. In one or more embodiments, the window may be color tinted.

Figure 3:
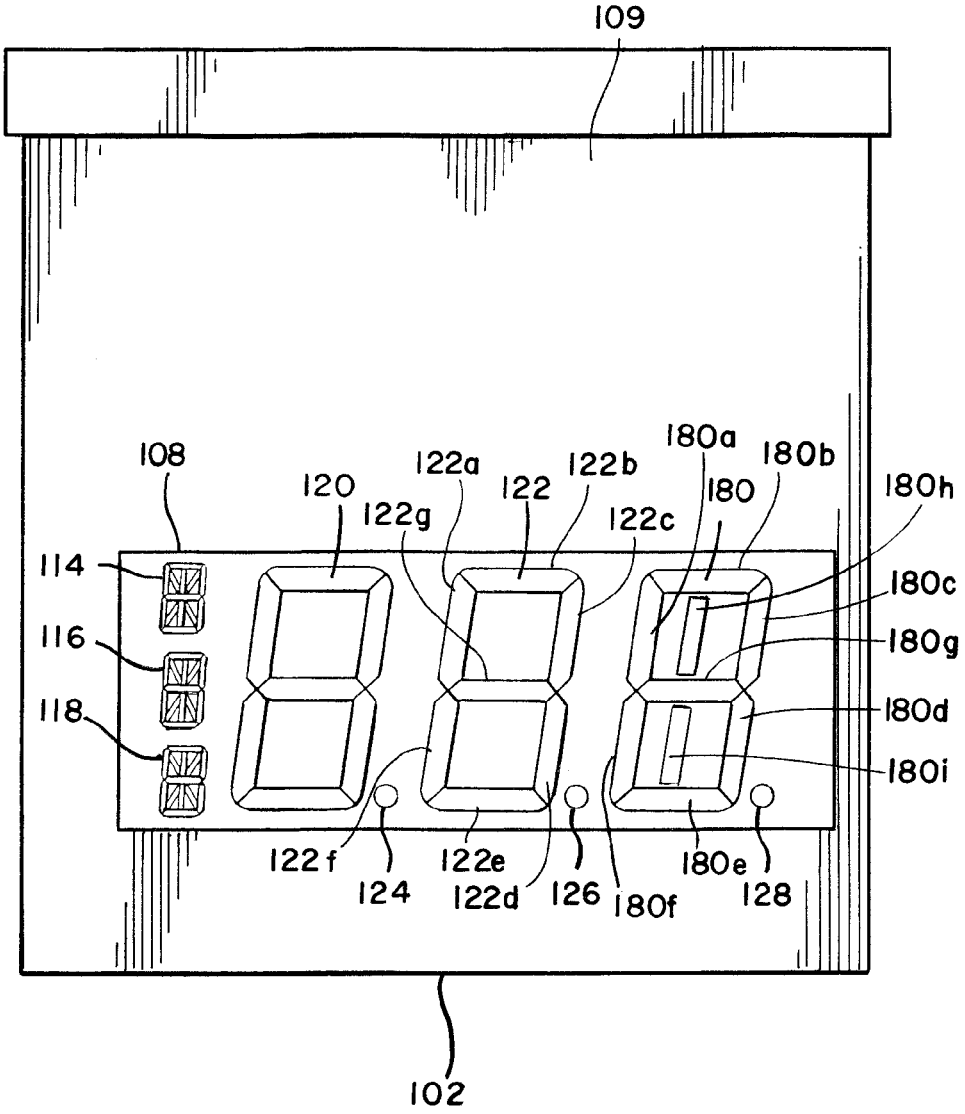
FIG. 3 is a front view of the lottery sign with the overlay removed.

FIG. 3 is a front view of the lottery sign with the graphic overlay 140 removed. The housing 102 has a transparent backlight panel 109. The backlight panel 109 extends across the front surface of the housing unit 102 and emits light which is projected through the graphic overlay panel 140.

The preferred light emitting array 108 comprises three alphanumeric LED modules 114, 116, and 118. In one or more embodiments, LED modules 114, 116, and 118 each have 13 line segments. These three LED modules 114, 116, and 118 may be employed to indicate a day of the week such as the day of the next lottery draw. The modules 114, 116, and 118 may be selectively illuminated to vertically form the visual indicia for "MON," "TUE," "WED," "THU," "FRI," "SAT," or "SUN."

Light emitting array 108 also has three LED modules 120, 122, and 180 positioned next to each other. The leftmost LED module 120 nominally provides indicia of the hundreds place for the jackpot value, the center LED module 122 nominally provides indicia of the tens place, and the rightmost LED module 180 nominally provides indicia of the units value of the jackpot. The light emitting array 108 also has a first, second, and third decimal points 124, 126, and 128 such that the leftmost LED module 120 or the center LED module 122 may nominally provide indicia of the units value of the jackpot.

Both the leftmost and center LED modules 120 and 122 have seven line segments for displaying numerals 0 through 9. For example, LED module 122 has seven segments 122*a*, 122*b*, 122*c*, 122*d*, 122*e*, 122*f*, and 122*g* positioned to form a figure "8" for displaying numerals 0 through 9. The LED module 180, however, uniquely has nine segments comprising seven segments 180*a*, 180*b*, 180*c*, 180*d*, 180*e*, 180*f*, and 180*g* forming a figure "8," as well as two interior vertical segments 180*h* and 180*i* that are substantially vertical and, preferably, shifted slightly left of center. In one or more embodiments, the seven segments 180*a*-180*g* of the LED module 180 are sized and positioned identical to that of the seven segments 122*a*-122*g* of the LED module 122. As such, the numerals displayed by the LED modules 120 and 122 having seven segments will appear identical to the numerals displayed by the LED module 180 having nine segments.

In addition to displaying numerals 0 through 9, by virtue of the two interior vertical segments 180*h* and 180*i*, LED module 180 is also uniquely configured to display an uppercase letter "B" when segments 180*b*, 180*c*, 180*d*, 180*e*, 180*g*, 180*h*, and 180*i* are energized. Hence, LED module 180 may be energized to display numerals 0 through 9 as well as an uppercase letter "B."

In one or more embodiments, the arrangement of having LED modules 120, 122, and 180, along with the decimal points 124, 126, and 128 enable the light emitting array 108 to generate values ranging from 0.01 (i.e., 0.01 million) through 99B (i.e., 99 billion). Hence, this light emitting array 108 may display jackpot values having a range of almost seven orders of magnitude (i.e., almost seven decades of jackpot values).

Figure 4:
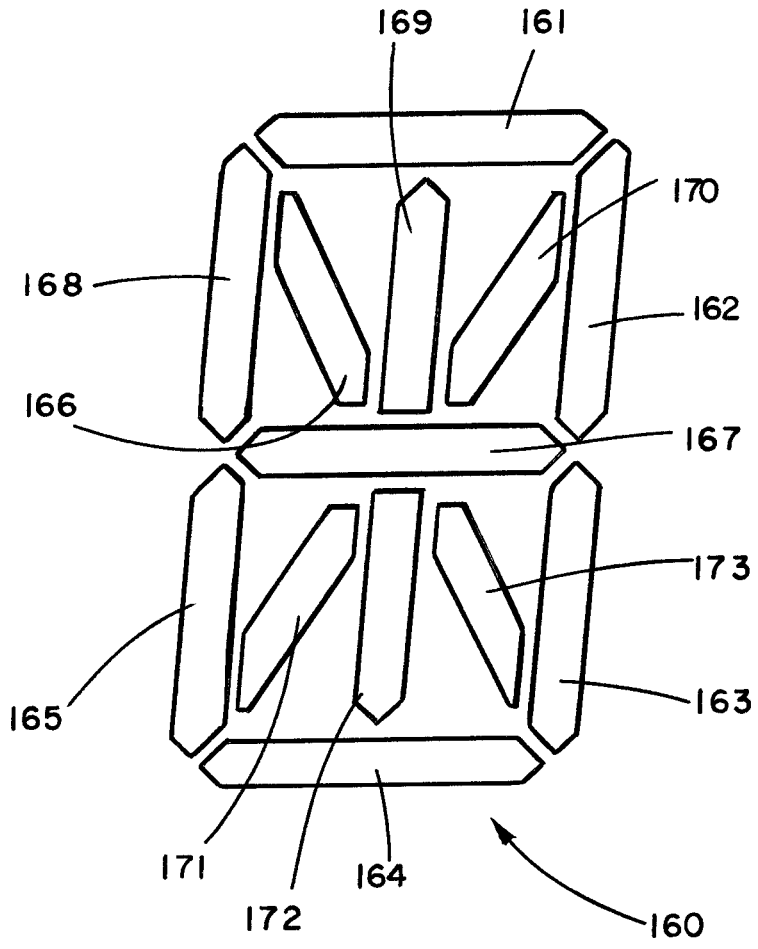
FIG. 4 is a front view of an LED module having 13 segments.

FIG. 4 is a front view of an LED module 160 having 13 segments. The LED module 160 is comprised of four vertical segments 162, 163, 165, and 168 and three horizontal segments including a top horizontal segment 161, a middle horizontal segment 167, and a bottom horizontal segment 164, the seven LED segments 161, 162, 163, 164, 165, 168, and 167 forming a figure "8." The LED module 160 also has a first interior vertical segment 172 extending from the center of the bottom horizontal segment 164 toward the center of the middle horizontal segment 167, and a second vertical segment 169 extending from the center of the middle horizontal segment 167 toward the center of the top horizontal segment 161. The first and second interior vertical segments 164 and 169 are positioned collinear with each other and parallel with the four vertical segments 162, 163, 165, and 168. The LED module 160 also has 4 additional segments 166, 170, 173, and 171 extending from the center region of the middle horizontal segment 167. Segment 166 extends toward the upper left corner formed by segments 168 and 161, segment 170 extends toward the upper right corner formed by segments 161 and 162, segment 173 extends toward the lower right corner formed by segments 163 and 164, and segment 171 extends toward the lower left corner formed by segments 164 and 165.

The LED module 160 of FIG. 4 is useful for displaying the letters for the 3-character abbreviations for the days of the week (MON, TUE, WED, THU, FRI, SAT, and SUN), but it includes many more segments than are necessary when the main goal is to simply display the numerals 0 to 9. Moreover, trying to display a capital letter "B" by illuminating the segments corresponding to 3, along with the centered segments 169, 172, does not unambiguously appear like a capital letter B.

Figure 5:
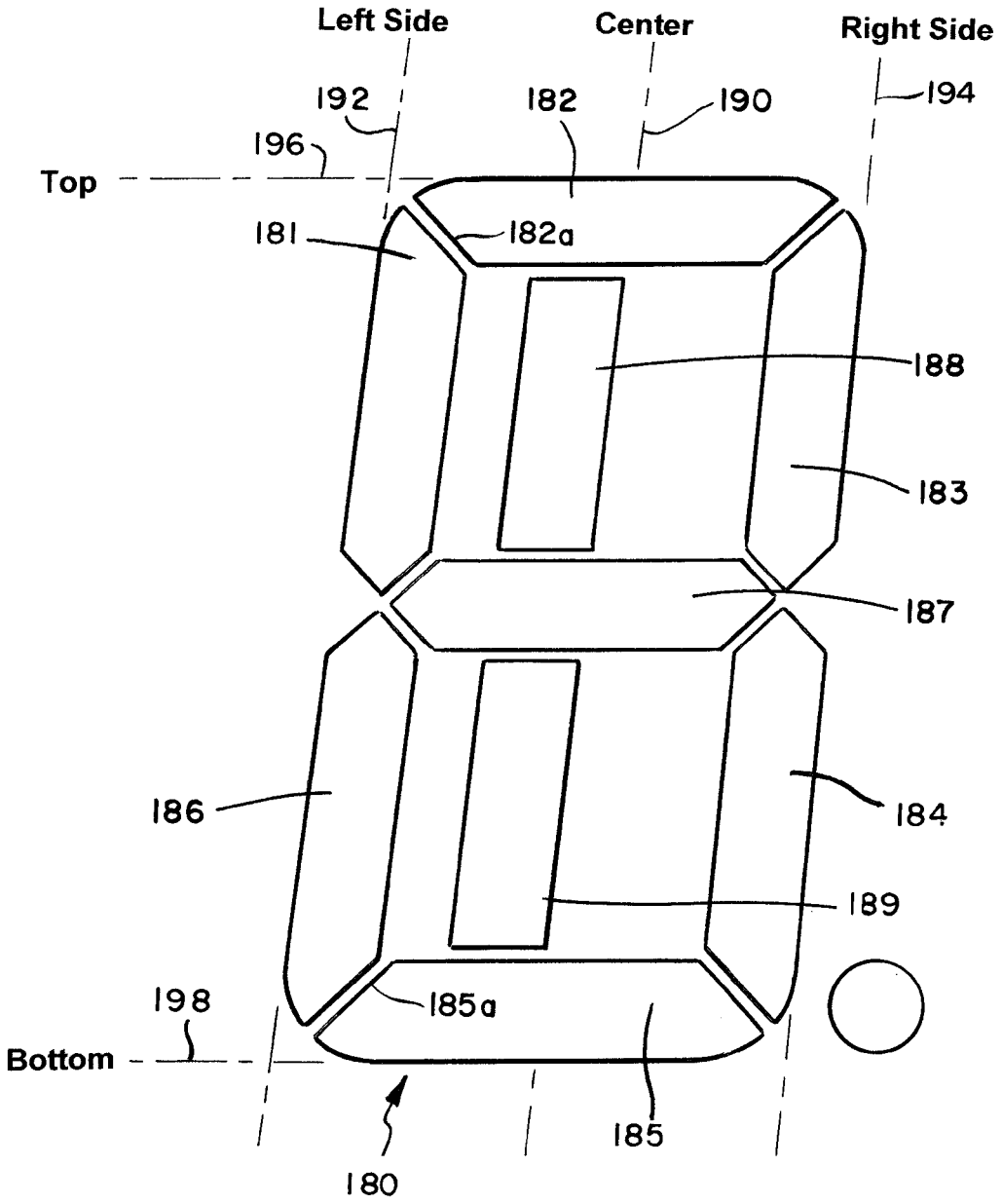
FIG. 5 is a front view of an LED module having 9 segments.

FIG. 5 is a front view of an LED module 180 having only 9 line segments. The nine segment LED module 180 comprises seven LED line segments 181, 182, 183, 184, 185, 186, and 187 having four vertical line segments 181, 186, 183, and 184 and three horizontal line segments 182, 187, and 185 including a top horizontal line segment 182, a middle horizontal line segment 187, and a bottom horizontal line segment 185 where seven LED line segments 181-187 form a figure "8". The nine segment LED module 180 further comprises a first interior vertical line segment 189 extending from the bottom horizontal line segment 185 to the middle horizontal line segment 187, and a second vertical line segment 188 extending from the middle horizontal line segment 187 to the top horizontal line segment 182. The first interior vertical line segment 189 and second interior vertical line segment 188 are positioned collinear with each other, parallel with the four vertical line segments 181, 186, 183, and 184, and slightly left of center.

In other words, the nine segment LED module 180 comprises three substantially horizontal discrete and elongated LED line segments 182, 187, and 185 including an upper horizontal line segment 182, a middle horizontal line segment 187, and a lower horizontal line segment 185. The LED module 180 has a left side marked by line 192, a center line marked by line 190, a right side marked by line 194, a top marked by line 196, and a bottom marked by line 198.

Two aligned, substantially vertical line segments 181 and 186 are positioned on the left of the upper horizontal line segment 182, the middle horizontal line segment 187, and the lower horizontal line segment 185 comprising a top left vertical line segment 181 and a bottom left vertical line segment 186. The top left vertical line segment 181 extends from the left end of the middle horizontal line segment 187 to the left end of the upper horizontal line segment 182. The bottom left line segment 186 extends from the left end of the middle horizontal line segment 187 to the left end of the lower horizontal line segment 185.

Two aligned, substantially vertical line segments 183 and 184 are positioned on the right of the upper horizontal line segment 182, the middle horizontal line segment 187, and the lower horizontal line segment 185 comprise a top right vertical line segment 183 and a bottom right vertical line segment 184. The top right vertical line segment 183 extends from the right end of the middle horizontal line segment 187 to the right end of the upper horizontal line segment 182. The bottom right line segment 184 extends from the right end of the middle horizontal line segment 187 to the right end of the lower horizontal line segment 185.

The LED module 180 also has two aligned, substantially vertical interior line segments 188 and 189 positioned to the left of the centers of the upper horizontal line segment 182, the middle horizontal line segment 187, and lower horizontal line segment 185 comprising a top interior vertical line segment 188 and a bottom interior vertical line segment 189. The top interior vertical line segment 188 extends from left of the center of the middle horizontal line segment 187 to the left of the center of the upper horizontal line segment 182. The bottom interior line segment 189 extends from the left of the center of the middle horizontal line segment 187 to the left of the center of the lower horizontal line segment 185.

In one or more embodiments, the line segments may have bevels formed for enhancing the quality of the display. For example, the upper horizontal line segment 182 has a beveled edge 182*a* and the lower horizontal line segment 185 has a beveled edge 185*a*. In one or more embodiments, the beveled edges 182*a* and 185*a* provide an illusion to a user that the top and bottom horizontal line segment 182 and 185 is connected to the vertical interior line segments 188 and 189 which may enhance the visual quality of the uppercase letter "B."

Figure 6:
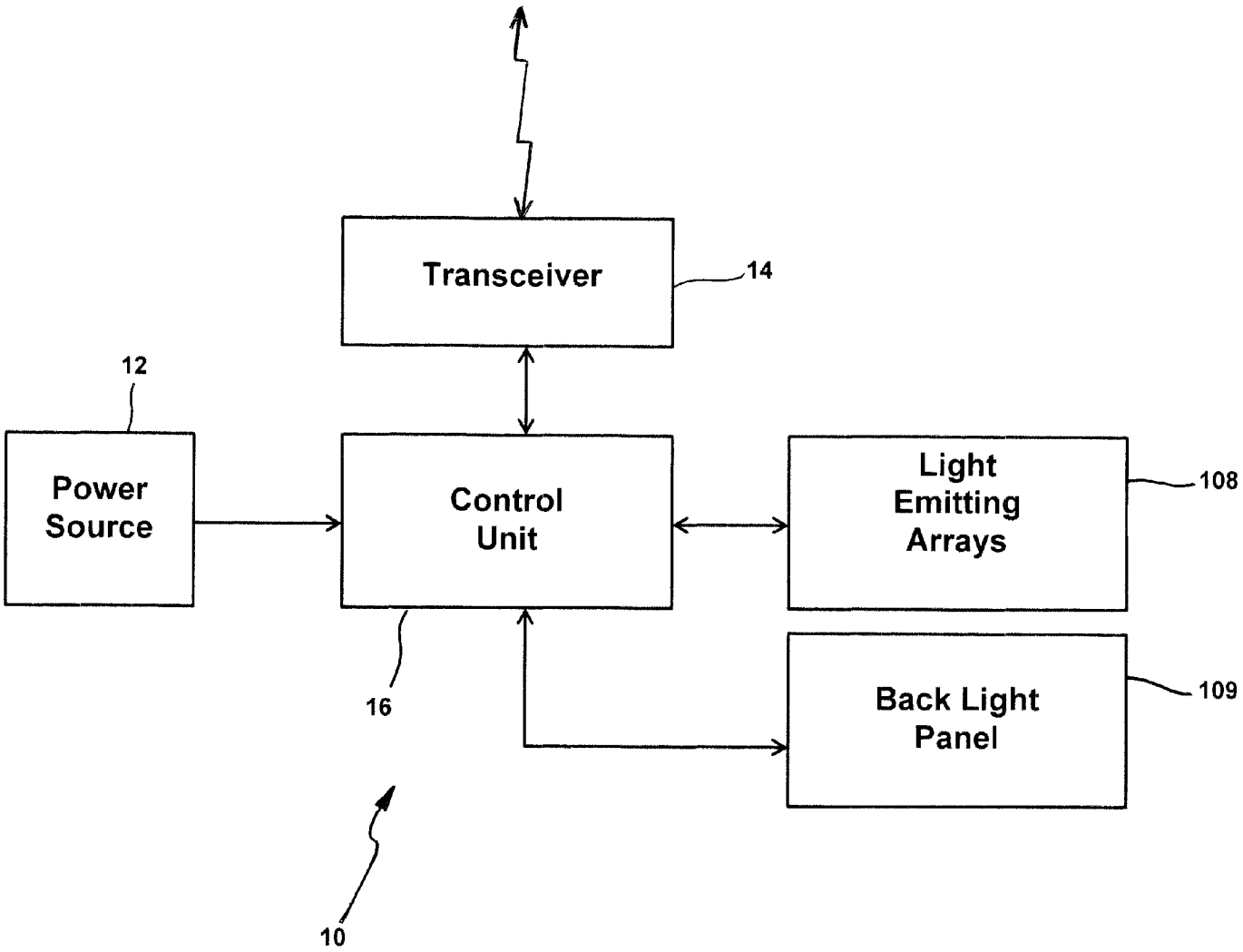
FIG. 6 is a schematic, block diagram of a circuit for controlling the illuminated sign.

FIG. 6 is a schematic, block diagram of a circuit 10 for operating the illuminated sign 101. The circuit 10 has a power source 12, a control unit 16 (i.e. a controller), a transceiver 14, as well as the light emitting array 108, and backlight panel 109. The power source 12 provides power to the controller 16, the transceiver 14, the light emitting array 108, and the backlight panel 109. The control unit 16 receives and transmits data via the transceiver 14. The control unit 16 also controls the light emitting array 108, as well as the backlight panel 109. The control unit 16 may receive information such as the current jackpot value and the day of the draw, and then selectively energize LED segments or discrete LEDs in the light emitting arrays to provide visual indicia of status of the current lottery jackpot.

Figure 7:
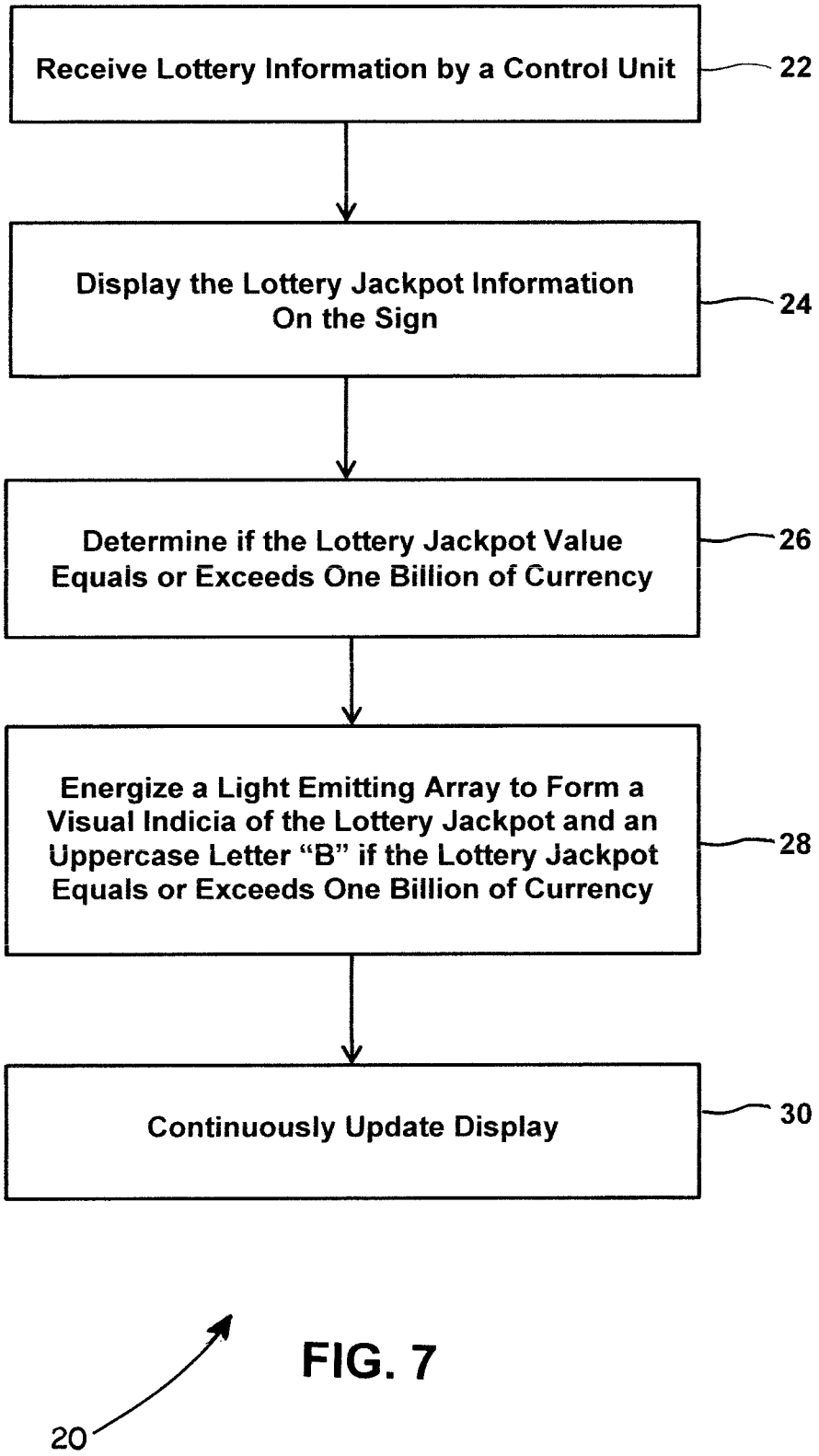
FIG. 7 is a flowchart of an exemplary process for controlling the illuminated sign.

FIG. 7 is an exemplary flowchart illustrating an exemplary process 20 for displaying lottery information on a sign 101. Lottery information is received by a control unit 16 via a transceiver 14 in an embodiment (step 22). The control unit 16 interprets the lottery information and displays the lottery jackpot information on the sign 101 (step 24). The control unit 16 determines if the lottery jackpot value equals or exceeds one billion of currency (step 26). If the lottery jackpot equals or exceeds one billion of currency, the control unit 16 energizes one or more of the light emitting arrays 108 or 110 to form a visual indicia of the lottery jackpot and an uppercase letter "B" (step 28). The control unit 16 continuously receives information via the transceiver 14 and updates the display (step 30).

Figure 8:
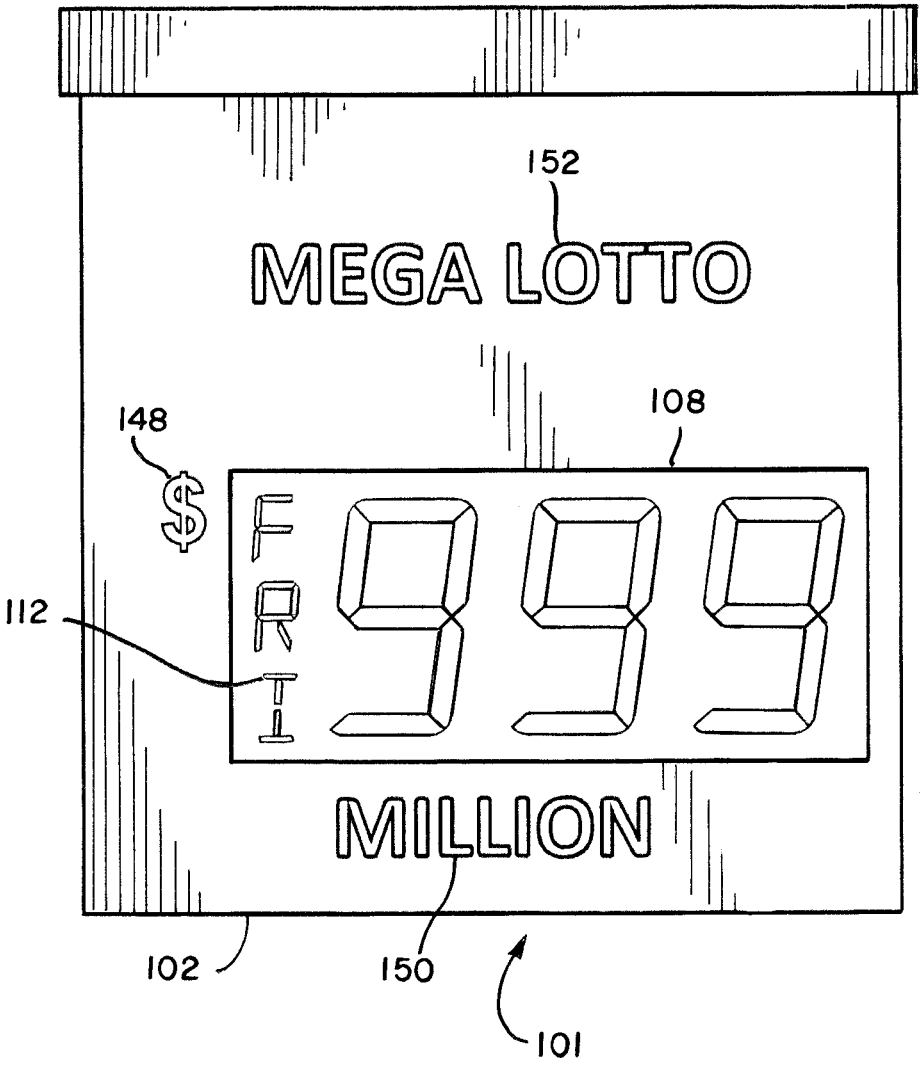
FIG. 8 is a front view of the lottery sign indicating that the lottery jackpot is 999 million dollars.
Figure 9:
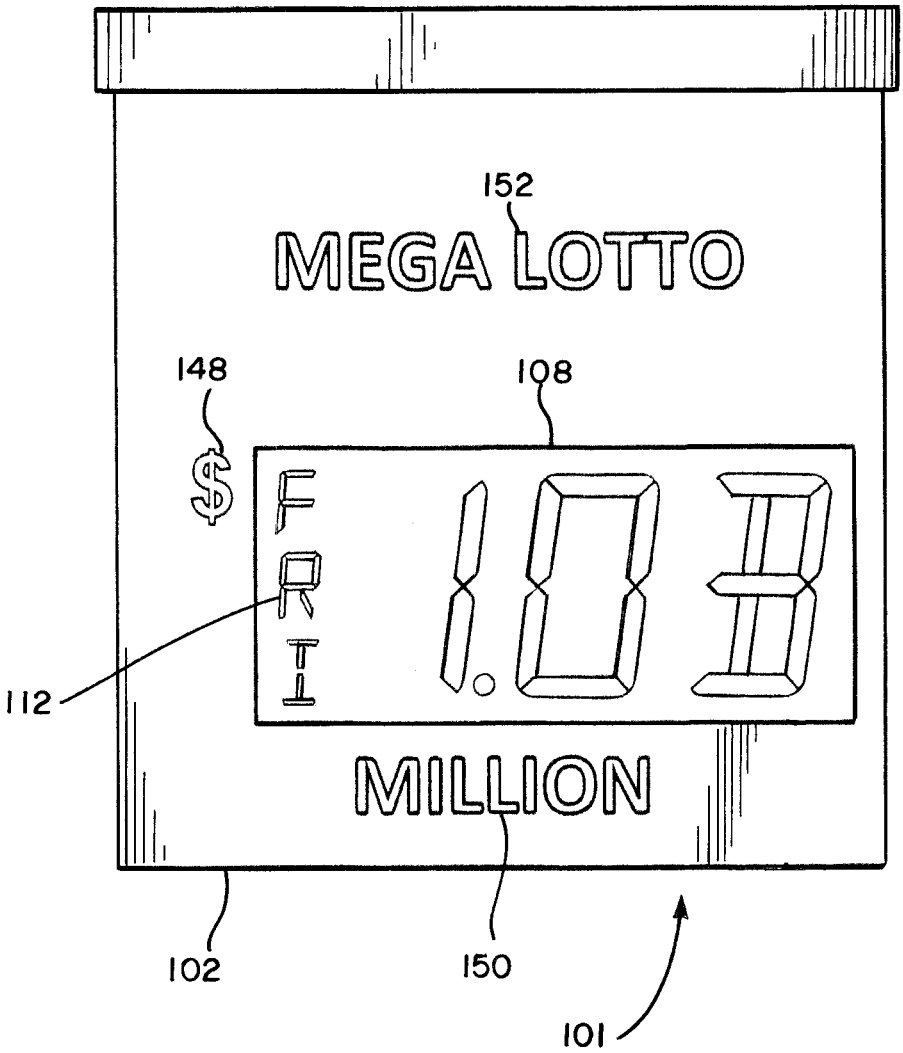
FIG. 9 is a front view of the lottery sign indicating that the lottery jackpot is 1 billion dollars.

FIGS. 8 and 9 are front views of the lottery sign 101 displaying lottery information. The housing 102 has a logo 152 indicating that the lottery is the "MEGA LOTTO," as well as visual indicia for the currency 148, and indicia for "MILLION" 150. The light emitting array 108 has indicia for the day of the draw 112, which is listed as "FRI" for Friday in this example, as well as an illuminated current value of the jackpot of "999." Hence a user would interpret the sign as showing that the MEGA LOTTO has a current jackpot of 999 million dollars, and that the day of the lottery draw is on Friday.

FIG. 9 illustrates the sign 101 when the current jackpot is 1 billion dollars. Here, the light emitting array 108 shows that the current jackpot is "1.0B." While the indicia for "MILLION" is listed, a user would interpret the displayed value as 1.0 billion dollars as a result of the prominent "B" in the illuminated display. Moreover, users who follow the lottery would realize that the jackpot is growing, and would not interpret the display as indicating 1.0 Million dollars. Moreover, in one or more embodiments, the uppercase letter "B" may blink to indicate the jackpot is in excess of one billion dollars. In one or more embodiments, the uppercase letter "B" is repeatedly and periodically energized and de-energized, causing the uppercase letter "B" to blink and illuminate repeatedly.

Although the invention has been discussed with reference to specific embodiments, it is apparent and should be understood that the concept can be otherwise embodied to achieve the advantages discussed. The preferred embodiments above have been described primarily as electronic lottery signs for displaying jackpots in the millions and billions of dollars. In this regard, the foregoing description of the lottery signs is presented for purposes of illustration and description. It shall be apparent that various displays would benefit from having a display showing millions or billions of dollars.

Furthermore, the description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. An illuminated display for displaying a lottery jackpot value in the range of millions and billions of currency, the display comprising:

a flat housing unit having a front surface;

one or more seven segment light emitting diode ("LED") modules mounted in the housing and configured to provide a visible indicia of numerals;

a nine segment LED module configured to display indicia of numerals and indicia of an uppercase letter "B", wherein the nine segment LED module comprises:

three substantially horizontal discrete and elongated LED line segments including an upper, middle, and lower horizontal line segments;

two aligned, substantially vertical line segments positioned on the left of the upper, middle, and lower horizontal line segments comprising a top left vertical line segment and a bottom left vertical line segment, the top left vertical segment extending from the left end of the middle horizontal line segment to the left end of the upper horizontal line segment, the bottom left horizontal line segment extending from the left end of the middle horizontal line segment to the left end of the lower horizontal line segment;

two aligned, substantially vertical line segments positioned on the right of the upper, middle, and lower horizontal line segments comprising a top right vertical line segment and a bottom right vertical line segment, the top right vertical segment extending from the right end of the middle horizontal line segment to the right end of the upper horizontal line segment, the bottom right vertical line segment extending from the right end of the middle horizontal line segment to the right end of the lower horizontal line segment; and, two aligned, substantially vertical interior line segments positioned to the left of the centers of the upper, middle, and lower horizontal line segments comprising a top interior vertical line segment and a bottom interior vertical line segment, the top interior vertical line segment extending from left of the center of the middle horizontal line segment to the left of the center of the upper horizontal line segment, the bottom interior vertical line segment extending from the left of the center of the middle horizontal line segment to the left of the center of the lower horizontal line segment;

a controller for operating the one or more seven segment LED modules and the nine segment LED module, the controller receiving a lottery jackpot value and displaying the lottery jackpot value on the seven and nine segment LED modules, wherein the controller energizes the nine segment LED module to display an uppercase letter "B" when the lottery jackpot value is equal to or exceeds one billion of currency;

a transparent backlight panel extending across the front surface of the housing unit; and, a replaceable graphic overlay placed on the front surface of the housing unit, the replaceable graphic overlay configured to be backlit by the backlight panel, the graphic overlay having visible indicia.

2. The illuminated display for displaying the lottery jackpot value in the range of millions and billions of currency of claim 1, further comprising three alphanumeric LED modules configured to display indicia of a day of a week.

3. The illuminated display for displaying the lottery jackpot value in the range of millions and billions of currency of claim 2, wherein each of the alphanumeric LED modules comprise a 13 segment LED module.

4. The illuminated display for displaying the lottery jackpot value in the range of millions and billions of currency of claim 1, wherein one or more of the seven segment LED modules or the nine segment LED module further comprises an LED decimal point.

5. The illuminated display for displaying the lottery jackpot value in the range of millions and billions of currency of claim 1, wherein the graphic overlay further comprises:

a window section for passing the light from the seven and nine segment LED module;

indicia of currency; and, indicia of "MILLION".

6. The illuminated display for displaying the lottery jackpot value in the range of millions and billions of currency of claim 5, wherein the indicia of currency is indicia of dollars.

7. The illuminated display for displaying the lottery jackpot value in the range of millions and billions of currency of claim 1, wherein the controller repeatedly and periodically energizes and de-energizes the nine segment LED module to display a blinking, uppercase letter "B" when the lottery jackpot value is equal to or exceeds one billion of currency.

8. An illuminated display for displaying a lottery jackpot value in the range of millions and billions of currency, the display comprising:

a flat housing unit having a front surface; and, a nine segment LED module configured to display indicia of numerals and indicia of an uppercase letter "B", wherein the nine segment LED module comprises:

three substantially horizontal discrete and elongated LED line segments including an upper, middle, and lower horizontal line segments;

two aligned, substantially vertical line segments positioned on the left of the upper, middle, and lower horizontal line segments comprising a top left vertical line segment and a bottom left vertical line segment, the top left vertical segment extending from the left end of the middle horizontal line segment to the left end of the upper horizontal line segment, the bottom left horizontal line segment extending from the left end of the middle horizontal line segment to the left end of the lower horizontal line segment;

two aligned, substantially vertical line segments positioned on the right of the upper, middle, and lower horizontal line segments comprising a top right vertical line segment and a bottom right vertical line segment, the top right vertical segment extending from the right end of the middle horizontal line segment to the right end of the upper horizontal line segment, the bottom right vertical line segment extending from the right end of the middle horizontal line segment to the right end of the lower horizontal line segment; and, two aligned, substantially vertical interior line segments positioned to the left of the centers of the upper, middle, and lower horizontal line segments comprising a top interior vertical line segment and a bottom interior vertical line segment, the top interior vertical line segment extending from left of the center of the middle horizontal line segment to the left of the center of the upper horizontal line segment, the bottom interior vertical line segment extending from the left of the center of the middle horizontal line segment to the left of the center of the lower horizontal line segment.

9. The illuminated display for displaying the lottery jackpot value in the range of millions and billions of currency of claim 8 further comprising a controller for operating the light emitting array, the controller receiving a lottery jackpot value and displaying the lottery jackpot value on the light emitting array, when the controller determines the lottery jackpot value is equal to or exceeds one billion of currency and energizes the light emitting array to display the indicia of the uppercase letter "B" to the user.

10. The illuminated display for displaying the lottery jackpot value in the range of millions and billions of currency of claim 9, wherein the controller repeatedly and periodically energizes and de-energizes the light emitting array of LEDs configured to provide visual indicia a blinking, uppercase letter "B" to the user.

11. The illuminated display for displaying the lottery jackpot value in the range of millions and billions of currency of claim 8, further comprising three alphanumeric LED modules configured to display indicia of a day of a week.

12. The illuminated display for displaying the lottery jackpot value in the range of millions and billions of currency of claim 11, wherein each of the alphanumeric LED modules comprise a 13 segment LED module.

13. The illuminated display for displaying the lottery jackpot value in the range of millions and billions of currency of claim 8, wherein, the light emitting array of LEDs further comprises an LED decimal point.

14. The illuminated display for displaying the lottery jackpot value in the range of millions and billions of currency of claim 8, wherein the graphic overlay further comprises:

a window section for passing the light from the seven and nine segment LED module;

indicia of currency; and, indicia of "MILLION".

15. The illuminated display for displaying the lottery jackpot value in the range of millions and billions of currency of claim 14, wherein the indicia of currency is indicia of dollars.

16. An illuminated display for displaying a lottery jackpot value in the range of millions and billions of currency, the display comprising:

a flat housing unit having a front surface; and, a nine segment LED module configured to display indicia of numerals and indicia of an uppercase letter "B", wherein the nine segment LED module comprises seven LED segments having four vertical segments and three horizontal segments including a top, middle, and bottom horizontal segment, the seven LED segments forming a figure "8", the nine segment LED module further comprising a first interior vertical segment extending from the bottom horizontal segment to the middle horizontal segment, and a second interior vertical segment extending from the middle horizontal segment to the top horizontal segment, the first and second interior vertical segments positioned collinear with each other and parallel with the four vertical segments of the seven LED segments, the first interior vertical segment and the second interior vertical segment positioned to the left of the centers of the top, middle, and bottom horizontal segments.

17. The illuminated display for displaying the lottery jackpot value in the range of millions and billions of currency of claim 16 further comprising a controller for operating the light emitting array, the controller receiving a lottery jackpot value and displaying the lottery jackpot value on the light emitting array, when the controller determines the lottery jackpot value is equal to or exceeds one billion of currency and energizes the light emitting array to display the indicia of the uppercase letter "B" to the user.

18. The illuminated display for displaying the lottery jackpot value in the range of millions and billions of currency of claim 16, further comprising three alphanumeric LED modules configured to display indicia of a day of a week.

19. The illuminated display for displaying the lottery jackpot value in the range of millions and billions of currency of claim 18, wherein each of the alphanumeric LED modules comprise a 13 segment LED module.

20. The illuminated display for displaying the lottery jackpot value in the range of millions and billions of currency of claim 16, wherein, the light emitting array of LEDs further comprises an LED decimal point.

21. The illuminated display for displaying the lottery jackpot value in the range of millions and billions of currency of claim 16, wherein the graphic overlay further comprises:

a window section for passing the light from the seven and nine segment LED module;

indicia of currency; and, indicia of "MILLION".

22. The illuminated display for displaying the lottery jackpot value in the range of millions and billions of currency of claim 21, wherein the indicia of currency is indicia of dollars.

23. The illuminated display for displaying the lottery jackpot value in the range of millions and billions of currency of claim 16, wherein the controller repeatedly and periodically energizes and de-energizes the light emitting array of LEDs configured to provide visual indicia a blinking, uppercase letter "B" to the user.

* * * * *